United States Patent [19]

Jaschinski

[11] Patent Number: 4,498,607

[45] Date of Patent: Feb. 12, 1985

[54] ADJUSTABLE RATE ICE CUBE DISPENSER

[75] Inventor: John J. Jaschinski, Two Rivers, Wis.

[73] Assignee: The Manitowoc Company, Inc., Manitowoc, Wis.

[21] Appl. No.: 438,330

[22] Filed: Nov. 1, 1982

[51] Int. Cl.[3] ..... B67D 5/62

[52] U.S. Cl. ..... 222/146.6; 222/547; 62/344

[58] Field of Search ..... 222/146 C, 410, 350, 222/353, 564, 547, 544, 235, 185, 566, 460; 221/311; 141/360–362; 62/394, 344

[56] References Cited

U.S. PATENT DOCUMENTS

| | | | |
|---|---|---|---|
| 1,938,942 | 12/1933 | Swartz | 222/547 |
| 3,353,725 | 11/1967 | Caceres | 222/564 |
| 4,049,161 | 9/1977 | Kohl | 222/146 C |
| 4,102,660 | 7/1978 | Beckett et al. | 221/311 |
| 4,228,923 | 10/1980 | Barnard | 222/146 C |
| 4,248,276 | 2/1981 | Gosnell | 141/362 |
| 4,373,645 | 2/1983 | Boyd | 222/460 |
| 4,386,640 | 6/1983 | Carr et al. | 141/361 |

*Primary Examiner*—Joseph J. Rolla
*Assistant Examiner*—Kenneth Noland
*Attorney, Agent, or Firm*—Leydig, Voit, Osann, Mayer & Holt, Ltd.

[57] ABSTRACT

An ice cube dispenser with a cylindrical bin having a bottom arcuate ramp leading to a side opening through which ice cubes are pushed by rotating agitator blades. The cube dispensing rate is adjusted by positioning a deflector plate from the ramp to a selected vertical position in the opening, thus effectively changing the opening size. The dispensed cubes are guided by plates defining a flexing wall chute. A glass trigger, when pivoted by a glass, opens a door over said opening and trips a switch that actuates the agitator blades.

4 Claims, 7 Drawing Figures

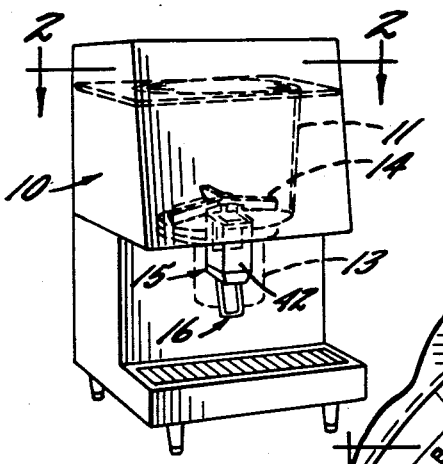
Fig. 1.
Fig. 2.
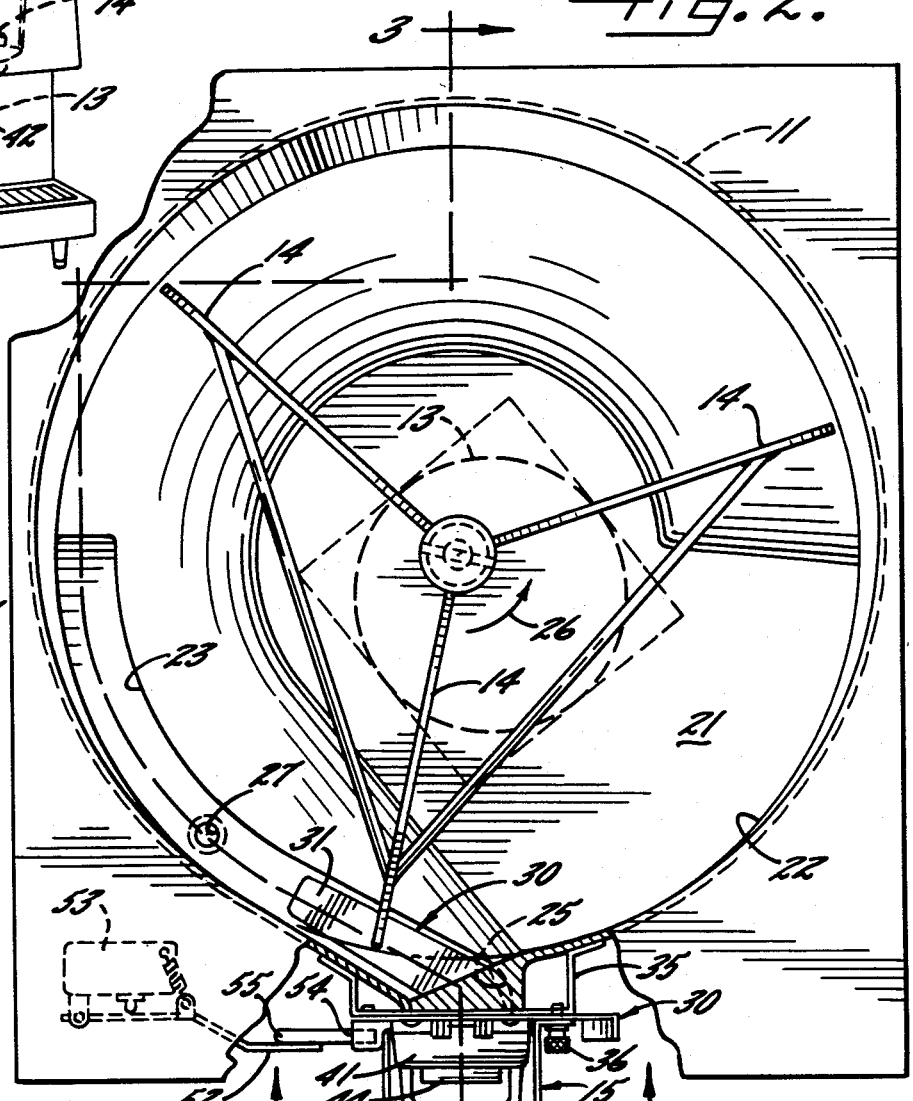
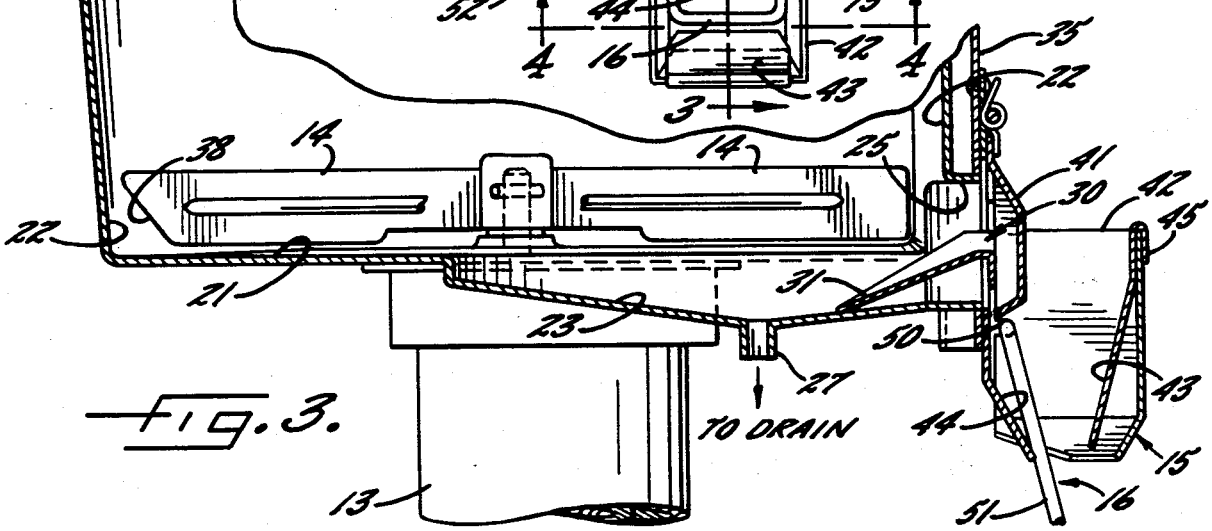
Fig. 3.

ADJUSTABLE RATE ICE CUBE DISPENSER

This invention relates generally to ice cube dispensing apparatus and more particularly concerns an adjustable rate ice cube dispenser.

An ice cube dispenser is intended for discharging ice cubes directly into a glass or similar container. Such dispensers may be placed on a counter, as in a cafeteria line, or positioned among other food serving equipment for use by employees serving iced beverages. Such dispensers are either associated with ice cube makers that dump cubes into the dispensing bin, or else have bins which are simply opened and manually filled with cubes from some other source.

When the dispenser is located for use by those intending to consume the ice cubes, it is desirable to provide a relatively low rate of cube delivery so that unfamiliarity with the machine will not result in ice spillage, i.e., waste. On the other hand, if the dispenser is being used by regular employees who can develop familiarity with the ice cube output characteristics, it is desirable to feed cubes at a far greater rate for service speed and efficiency.

Another factor affecting a dispenser's delivery characteristics is the size of the ice cubes. The assignee of this application markets ice cube makers producing regular cubes approximately $1\frac{1}{8}\times1\frac{1}{8}\times\frac{7}{8}$ inches, dice-sized cubes approximately $\frac{7}{8}\times\frac{7}{8}\times\frac{7}{8}$ inches, and half dice-sized cubes approximately $\frac{3}{8}\times\frac{7}{8}\times\frac{7}{8}$ inches. A dispenser discharge adjustment must handle, and compensate for, cubes of various size.

Accordingly, it is the primary aim of the invention to provide an ice cube dispenser with an effective adjustable delivery rate mechanism. A collateral object of the invention is to provide such a machine that is simple for the dispenser's owner to adjust.

Another object is to provide a dispensing mechanism as characterized above that can handle ice cubes of various sizes, and which is virtually independent of the size of the bin from which ice cubes are being dispensed.

A further object is to provide a dispensing mechanism of the above type which does not appreciably vary the torque on the dispensing motor drive when the cube dispensing rate is changed. A still further object is to provide a dispenser as referred to above which also has a cube delivery chute that is not subject to being jammed with ice cubes, and which permits a jam, if it does occur, to be easily broken.

It is also an object to provide a dispensing mechanism of the foregoing character which is inexpensive to manufacture, and which can easily be dismantled for cleaning and adjustment.

Other objects and advantages of the invention will become apparent upon reading the following detailed description and upon reference to the drawings, in which:

FIG. 1 is a perspective of an ice cube dispenser embodying the invention;

FIG. 2 is an enlarged section, with portions broken away, taken along line 2—2 in FIG. 1;

FIG. 3 is a fragmentary section taken approximately along line 3—3 in FIG. 2;

Figure 4:
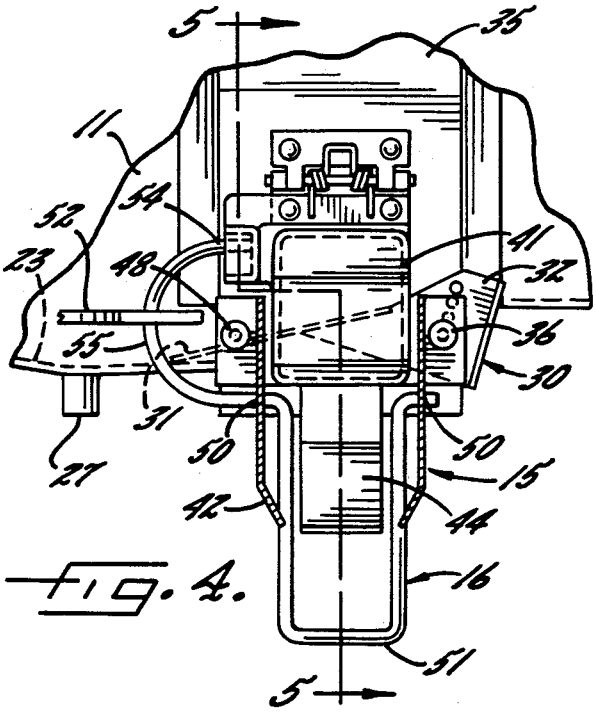
FIG. 4 is a fragmentary elevation taken along line 4—4 in FIG. 2.

While the invention will be described in connection with a preferred embodiment, it will be understood that I do not intend to limit the invention to that embodiment. On the contrary, I intend to cover all alternatives, modifications and equivalents as may be included within the spirit and scope of the invention as defined by the appended claims.

Turning now to the drawings, there is shown an ice cube dispenser 10 having an upper insulated bin 11 with an openable top, a lower compartment 12 containing a motor 13 for driving agitator blades 14, and a chute assembly 15 from which ice cubes, having been loaded into the bin 11, are dispensed. The illustrated dispenser 10 is intended to be placed on a counter or work table and to dispense ice upon pivoted movement of a glass trigger 16 caused by pushing a glass 17 or similar container against the trigger under the chute assembly 15.

The cube storage bin 11 has a generally circular bottom 21 surrounded by a cylindrical wall 22 with the bottom having an arcuate ramp 23 spiralling down from the level of the bottom 21 along a section of the wall 22 and ending at an opening 25 in the wall. The opening 25 is substantially larger than the largest ice cube intended to be dispensed. A plurality, in this case, three, agitator blades 14 are mounted for rotation in the direction of the arrow 26 within the wall 22 and just above the bottom 21 so as to sweep ice cubes in the bin 11 along the ramp 23 and out of the opening 25. Preferably, the ramp 23 has a bottom drain 27 for clearing melted ice water from the bin 11.

In accordance with the invention, a deflector plate 30 having an elongated surface 31 has one end resting on the ramp 23 and the other end extending through the opening 25 at a vertically adjustable height so as to vary the size of the opening, with the plate surface 31 effectively changing the ice cube path from the ramp 23 to the adjustably sized opening 25. In the illustrated embodiment, the plate 30 has a flanged portion 32 outside of the wall with a plurality of vertically spaced holes 33. A screw 34 is mounted in a projection 35 on the wall 22, and by passing the screw 34 through a selected one of the holes 33, the vertical height of the plate 30 can be easily adjusted. A thumb nut 36 and washer 37 thread on the screw to secure the plate in adjusted position.

Figure 7:
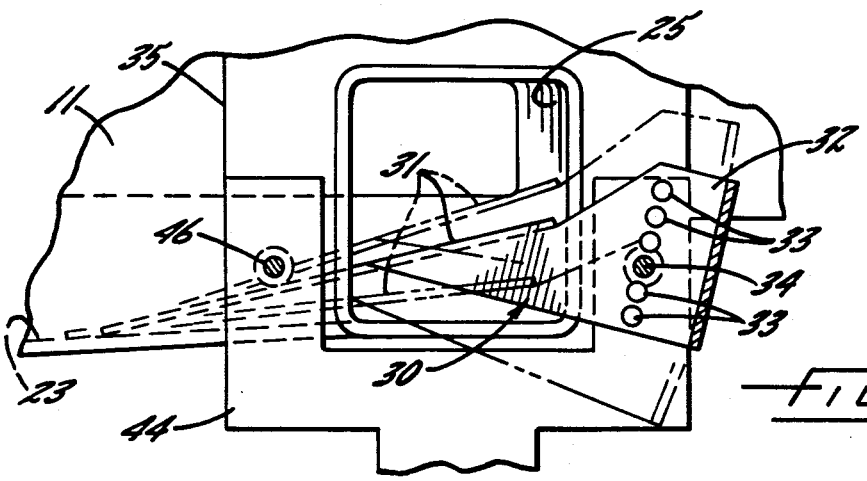
FIG. 7 is a fragmentary section and elevation taken approximately along line 7—7 in FIG. 6.

The blades 14 are driven when actuated at a substantially constant speed, so it can be seen that the cube dispensing rate is dependent upon the effective size of the opening 25. The larger the effective opening, the more cubes will be dispersed during a given time period. Because the plate 30 changes the effective ramp path to coincide with the opening size selected (see FIG. 7), there is little likelihood of ice jam-ups at the opening 25. Preferably, two of the blades 14 have ends beveled as at 38 so as to well clear the opening 25 and any ice cubes trapped against the opening edge. The third blade 14 is squared (see FIG. 3) so as to sweep closely past the opening, and thus break up any ice jams that do occur. By using only one blade 14 for this purpose, the load on the driving motor is minimized.

Figure 5:
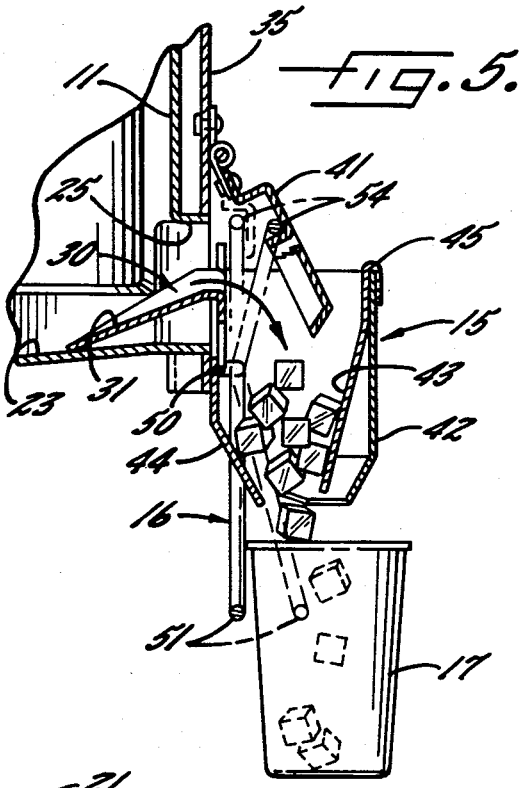
FIG. 5 is a fragmentary section taken approximately along line 5—5 in FIG. 4.
Figure 6:
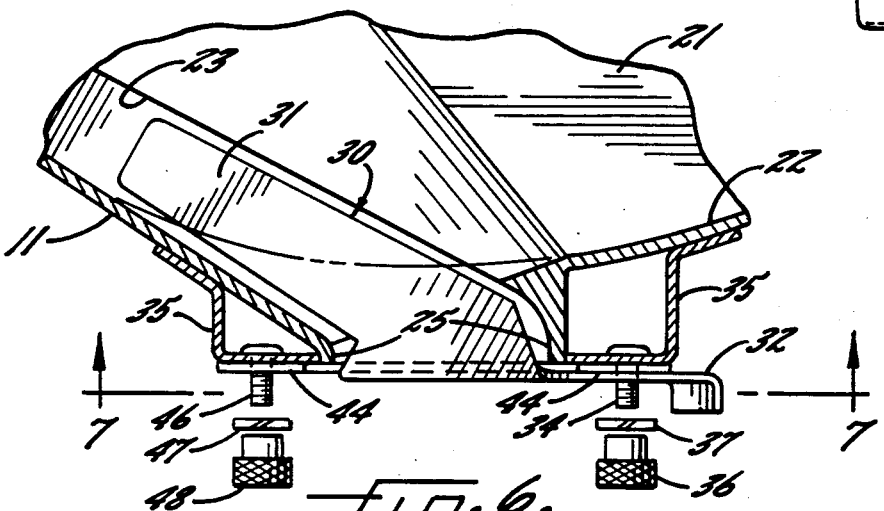
FIG. 6 is a fragmentary section, slightly enlarged, of a portion of the structure shown in FIGS. 4 and 5, with parts removed.

To keep foreign matter from entering the opening 25, a spring biased door 41 covers the outside of the opening 25 and is hinged to swing up. A generally three-sided cover 42 is mounted around the door 41, and a pair of flexible plates 43 and 44 are mounted within the cover 42 substantially parallel to the wall 22 and spaced from one another to define a flexing wall chute for directing ice downwardly from the opening (see FIG. 5). The flexible plates 43, 44 tend to avoid cube jams in the chute, but should there be a hang-up, it has been found that finger pressure flexing the wall plates usually frees the ice cubes.

The plate 43 has a hook-like flange 45 at its top and is mounted by simply being hooked onto the front panel of the cover 42. The screw 34, as well as holding the deflector plate 30, also mounts one side of the cover 42 and one side of the plate 44. The other sides of the cover 42 and plate 44 are mounted by a second screw 46, washer 47 and thumb nut 48, making the chute assembly 15 easy to dismantle for cleaning and adjustment.

The glass trigger 16 is in the form of a bent wire pivoted in notches 50 in the cover 42 with a portion 51 hanging beneath the chute for engagement by a glass 17 or similar container. An actuator 52 for the switch 53 powering the agitator blade motor 13 extends from the compartment 12 adjacent to the cover 42. The trigger 16 has an end portion 54 engaging the door 41 and another portion 55 adjacent the switch actuator 52. When a glass is pushed under the chute and against the trigger 16, the trigger pivots to trip the switch 53 and open the door 41.

It can now be seen that the ice cube dispenser 10 has a rate adjustment that can readily be understood by its owner. The deflector plate 30 is positioned using a selected hole 33 corresponding to the ice cube size and feed rate desired. A simple thumb nut and screw provides the adjustment and mounting required. The selected size of the opening 25 does not alter the torque requirements on the motor 13 driving the agitator blades 14.

Those familiar with this art will also appreciate that the dispenser 10 is of straightforward, essentially mechanical, design so as to be economical both for manufacture and servicing.

I claim as my invention:

1. An ice cube dispenser comprising, in combination, an ice cube storage bin having a bottom and a generally cylindrical lower wall surrounding said bottom, said bottom having an arcuate ramp spiraling down from the level of the bottom along a section of said wall and ending at an opening in the wall substantially larger than the largest ice cubes intended to be dispensed, a motor driven agitator blade mounted for rotation within said wall and just above said bottom so as to sweep ice cubes in said bin along said ramp and out of said opening, a deflector plate having an elongated surface resting at one end of said ramp and extending at the other end through said opening, means for vertically adjusting the point where said plate surface passes through said opening so as to vary the size of said opening with the plate surface effectively changing the ice cube path from the ramp to the adjustably sized opening.

2. The combination of claim 1 including additional agitator blades mounted symmetrically with said blade, all but one of said blades having beveled outer edges so as to clear the region near said wall opening, and one of said blades having a squared outer edge so as to pass said opening closely and thus break up possible ice cube jams at said opening.

3. The combination of claim 1 including a thumb nut and screw assembly releasably mounted in the outer side of said wall adjacent said opening, said deflector plate having a portion outside said opening with a plurality of vertically spaced holes, and said means for vertically adjusting said plate consists of passing said thumb nut and screw assembly through a selected one of said spaced holes.

4. An ice cube dispenser comprising, in combination, an ice cube storage bin having a bottom and a generally cylindrical lower wall surrounding said bottom, said bottom having an arcuate ramp spiraling down from the level of said bottom along a section of said wall and ending in an opening in the wall substantially larger than the largest ice cube intended to be dispensed, a motor driven agitator blade mounted for rotation within said wall and just above said bottom so as to sweep ice cubes in said bin along said ramp and out of said opening, a deflector plate having an elongated surface resting at one end on said ramp and extending at the other end through said opening, a generally three-sided cover mounted on the outside of said wall around said opening, a pair of flexible plates mounted within said cover substantially parallel to said wall and spaced from one another to define a flexing wall chute for directing ice cubes discharged through said opening, a thumb nut and screw assembly releasably mounted in the outer side of said wall adjacent said opening, said deflector plate having a portion outside said opening with a plurality of vertically spaced holes, whereby passing said thumb nut and screw assembly through a selected one of said spaced holes vertically adjusts the point where said plate surface passes through said opening so as to vary the size of said opening with the plate surface effectively changing the ice cube path from the ramp to the adjustably sized opening, said thumb nut and screw assembly also mounting one side of said cover and one side of one of said flexible plates.

* * * * *